US012654966B2

(12) United States Patent
Namiki

(10) Patent No.: US 12,654,966 B2
(45) Date of Patent: Jun. 16, 2026

(54) MEDIUM TRANSPORT DEVICE AND IMAGE READING DEVICE

(71) Applicant: SEIKO EPSON CORPORATION, Tokyo (JP)

(72) Inventor: Masaki Namiki, Kitakyushu (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 18/892,402

(22) Filed: Sep. 22, 2024

(65) Prior Publication Data

US 2025/0100827 A1 Mar. 27, 2025

(30) Foreign Application Priority Data

Sep. 22, 2023 (JP) ..... 2023-158086

(51) Int. Cl.

| | |
|---|---|
| ***B65H 3/06*** | (2006.01) |
| ***B65H 5/06*** | (2006.01) |
| ***B65H 5/36*** | (2006.01) |
| ***B65H 29/12*** | (2006.01) |

(52) U.S. Cl.

CPC ..... *B65H 5/06* (2013.01); *B65H 5/36* (2013.01); *B65H 2404/17* (2013.01); *B65H 2801/06* (2013.01)

(58) Field of Classification Search

CPC ..... B65H 3/06; B65H 3/0669; B65H 5/06; B65H 5/062; B65H 29/12; B65H 29/125; B65H 2601/324

See application file for complete search history.

(56) References Cited

U.S. PATENT DOCUMENTS

2004/0256787 A1* 12/2004 Wada ..... B65H 3/0669 271/109

FOREIGN PATENT DOCUMENTS

| | | | |
|---|---|---|---|
| JP | H0583491 | | 4/1993 |
| JP | 06156767 A | * | 6/1994 |
| JP | 2000147978 A | * | 5/2000 |

* cited by examiner

*Primary Examiner* — Luis A Gonzalez
(74) *Attorney, Agent, or Firm* — CHIP LAW GROUP

(57) ABSTRACT

A medium transport device includes a transport roller unit including transport rollers configured to transport a medium, and a drive unit that drives the transport rollers, the drive unit includes a power transmitting portion, the transport roller unit includes a power transmitted portion, the power transmitting portion and the power transmitted portion are brought into a coupled state by the transport roller unit moving in a direction approaching the drive unit, and the power transmitting portion and the power transmitted portion are brought into a uncoupled state by the transport roller unit moving in a direction away from the drive unit.

11 Claims, 10 Drawing Sheets

MEDIUM TRANSPORT DEVICE AND IMAGE READING DEVICE

The present application is based on, and claims priority from JP Application Serial Number 2023-158086, filed Sep. 22, 2023, the disclosure of which is hereby incorporated by reference herein in its entirety.

BACKGROUND

1. Technical Field

The present disclosure relates to a medium transport device and an image reading device.

2. Related Art

An example of this type of device includes a device described in JP-A-5-83491. JP-A-5-83491 discloses an image reading device including a document transport unit including a document transport means such as a first transport roller, a second transport roller, and a feed roller, and a driving means such as a motor, a pulley, and a belt for driving the document transport means.

In the device of JP-A-5-83491, for example, when only the first transport roller is replaced, it is necessary to remove the pulley and the belt. Therefore, it is necessary to adjust the tension of the belt after the first transport roller is replaced. The tension adjustment is troublesome and time-consuming.

SUMMARY

In order to solve the problem, a medium transport device according to the present disclosure includes a transport roller unit including transport rollers capable of transporting a medium, and a drive unit configured to drive the transport rollers, wherein the drive unit includes a power transmitting portion, the transport roller unit includes a power transmitted portion, the power transmitting portion and the power transmitted portion are brought into a coupled state by the transport roller unit moving in a direction approaching the drive unit, and the power transmitting portion and the power transmitted portion are brought into a uncoupled state by the transport roller unit moving in a direction away from the drive unit.

Further, the image reading device according to the present disclosure includes the medium transport device according to any one of first to seventh aspects to be described later, and a reading unit configured to read an image of the medium.

DESCRIPTION OF EMBODIMENTS

Figure 1:
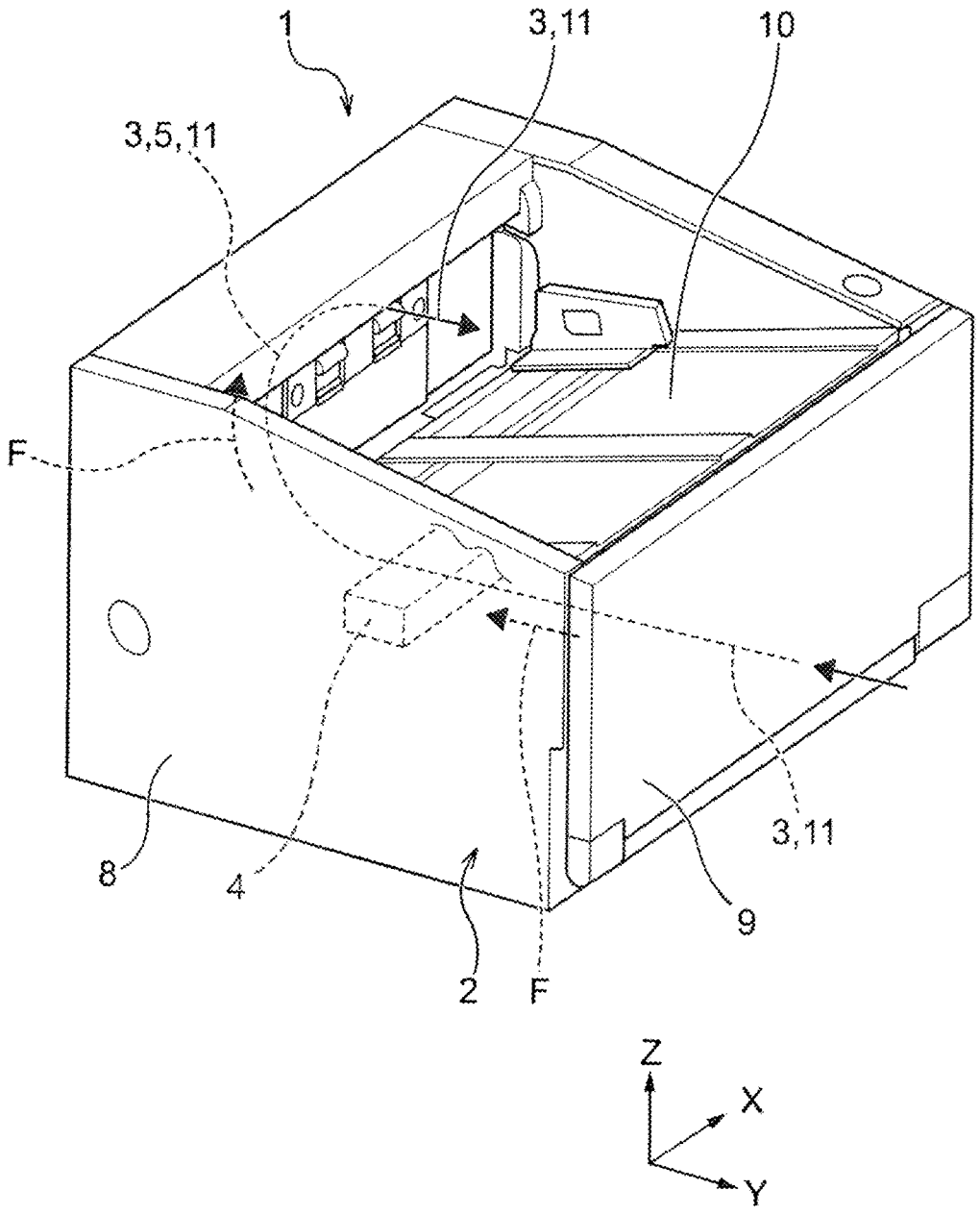
FIG. 1 is an external perspective view of an image reading device according to Embodiment 1.

The present disclosure will first be schematically described below.

In order to solve the problem, a first aspect of a medium transport device according to the present disclosure includes a transport roller unit including transport rollers capable of transporting a medium, and a drive unit configured to drive the transport roller, wherein the drive unit includes a power transmitting portion, the transport roller unit includes a power transmitted portion, the power transmitting portion and the power transmitted portion are brought into a coupled state by the transport roller unit moving in a direction approaching the drive unit, and the power transmitting portion and the power transmitted portion are brought into a uncoupled state by the transport roller unit moving in a direction away from the drive unit.

According to the present aspect, when the transport roller unit moves in a direction approaching the drive unit, the power transmitting portion and the power transmitted portion are brought into the coupled state, whereas when the transport roller unit moves in a direction away from the drive unit, the power transmitting portion and the power transmitted portion enter a uncoupled state. Accordingly, when it is desired to remove the transport roller for replacement or the like, the uncoupled state is obtained only by moving the transport roller unit in a direction away from the drive unit, and thus, it is possible to easily remove the transport roller. When the transport roller unit including another transport roller is newly attached, the coupled state is obtained only by moving the transport roller unit in a direction in which the transport roller unit approaches the drive unit, and thus it is possible to easily perform the attachment.

In other words, it is possible to remove or attach the transport roller unit only by moving the transport roller unit without putting a hand on the drive unit, that is, in a state as it is, and thus it is possible to easily perform the replacement of the transport roller. Further, it is not necessary to adjust the tension of the drive unit as in the related art, and it is possible to shorten a replacement time.

A second aspect of the medium transport device according to the present disclosure is an aspect dependent on the first aspect, and the transport roller unit includes a first frame, and a second frame facing the first frame, and includes a first shaft configured to support the transport roller, the first frame is located on one end side of the first shaft, the second frame is located on the other end side of the first shaft, the drive unit is held by the first frame, and the transport roller unit takes the coupled state and the uncoupled state by moving in a direction along the first shaft through an insertion portion of the second frame.

According to the present aspect, the transport roller unit can take the coupled state and the uncoupled state by moving in a direction along the first shaft through an insertion portion of the second frame. This makes it possible to replace the transport roller with a simple structure.

A third aspect of the medium transport device according to the present disclosure is an aspect dependent on the second aspect, and the power transmitted portion located at one end of the first shaft is a first gear, and the power transmitting portion is a second gear that meshes with the first gear.

According to the present aspect, both the power transmitted portion and the power transmitting portion are configured of gears. Accordingly, a structure for realizing the coupled state and the uncoupled state is simple, and a task for switching between these states is easy.

A fourth aspect of the medium transport device according to the present disclosure is an aspect dependent on the third aspect, and an inclined surface increasing an interval between adjacent teeth is formed at a portion where a plurality of first teeth of the first gear start to mesh with a plurality of second teeth of the second gear by moving in the approaching direction in at least one of the first gear and the second gear.

According to the present aspect, an inclined surface increasing an interval between adjacent teeth is formed at a portion where the first gear starts to mesh with the second gear by moving in an approaching direction in at least one of the first gear and the second gear. With the inclined surface, it is easy to move the transport roller unit in a direction approaching the drive unit and obtain the coupled state.

A fifth aspect of the medium transport device according to the present disclosure is an aspect dependent on the third aspect, and the drive unit includes a toothed belt, and a pulley around which the toothed belt is wound to rotate, and the second gear is attached to a second shaft serving as a rotation center of the pulley, and rotates integrally with the pulley.

The present aspect may also depend on the fourth aspects.

In the medium transport device, the drive unit has a structure in which the toothed belt and the pulley are included, and in the related art, when the transport roller is replaced, it is necessary to remove the toothed belt from the pulley.

However, in the present embodiment, the second gear is attached to the second shaft serving as the rotation center of the pulley and rotates integrally with the pulley. Therefore, change from the coupled state to the uncoupled state can occur by moving the transport roller unit in a direction away from the drive unit. This makes it possible to easily remove the transport roller unit from the drive unit and thus easily perform replacement of the transport roller.

A sixth aspect of the medium transport device according to the present disclosure is an aspect dependent on the second aspect, and the transport roller unit includes a support portion configured to rotatably support the first shaft, and a guide portion configured to guide the support portion at the time of movement is included between the first frame and the second frame.

The present aspect may also depend on any one of the third to fifth aspects.

According to the present aspect, when the transport roller unit is moved from the second frame side toward the first frame, the support portion is guided along the guide portion. This makes it possible to easily move the transport roller unit.

A seventh aspect of the medium transport device according to the present disclosure is an aspect dependent on the sixth aspect, and the support portion is electrically conductive, and includes a first support portion located on one end side of the first shaft and supporting the first shaft via a bearing, a second support portion located on the other end side of the first shaft and supporting the first shaft via a bearing, and a base support portion configured to couple the first support portion to the second support portion, and the first shaft and the support portion are coupled by a conductive member.

When the bearing continues to be used, characteristics of a lubricating oil inside the bearing deteriorates, and the conductivity of the bearing is degraded. Therefore, in a structure in which the first shaft is grounded via the bearing, there is concern that the grounding characteristic also deteriorates.

However, according to the present aspect, the first shaft and the conductive support portion are coupled by a conductive member such as brass. Thus, even when a grounding characteristic of the bearing is degraded, the first shaft can be continuously grounded by the conductive member.

An eighth aspect of an image reading device according to the present disclosure includes the medium transport device according to any one of first to seventh aspects, and a reading unit configured to read an image of the medium.

According to the present aspect, as the image reading device, it is possible to obtain the same effects as those of any one of the first to seventh aspects.

EMBODIMENT

Hereinafter, an embodiment of a medium transport device according to the present disclosure and an image reading device including the medium transport device will be specifically described with reference to the drawings.

In the following description, three axes that are perpendicular to each other will be referred to as an X-axis, a Y-axis, and a Z-axis as illustrated in each figure. Directions indicated by arrows of the three axes (X, Y, and Z) are +directions of the respective directions, and opposite directions are −directions. The Z-axis direction corresponds to a vertical direction, that is, a direction in which gravity acts, the +Z direction indicates a vertically upward direction, and the −Z direction indicates a vertically downward direction. The X-axis direction and the Y-axis direction correspond to horizontal directions. The +Y direction indicates a forward direction of the device, and the −Y direction indicates a rearward direction of the device. The +X direction indicates a rightward direction of the device, and the −X direction indicates a leftward direction of the device.

Embodiment 1

Image Reading Device

As illustrated in FIGS. 1 to 4, an image reading device 1 of the present embodiment includes a medium transport device 11 and a reading unit 4 inside a device body 2.

Figure 2:
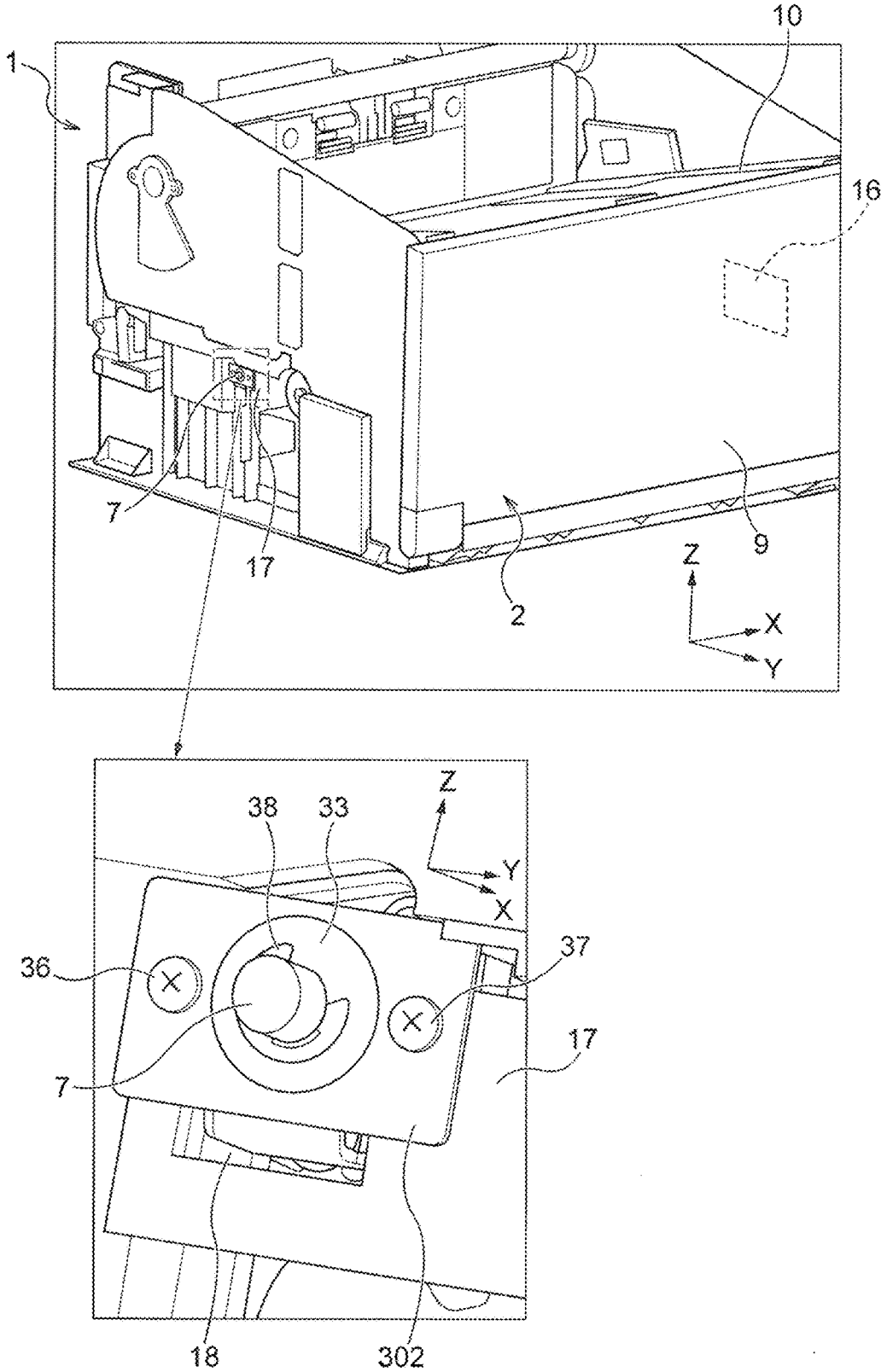
FIG. 2 is a perspective view of the image reading device of Embodiment 1 in a state where a side cover is removed.

The medium transport device 11 includes a transport path 3 for transporting a medium such as a sheet (not shown) in a transport direction F. In the transport path 3, a plurality of transport rollers 6 are disposed along the transport direction F as will be described later. The transport roller 6 is supported by a first shaft 7 (FIGS. 2, 3, and 4) and rotates integrally with the first shaft 7. The transport roller 6 applies a transport force to the medium in the transport direction F through rotation. In FIG. 2, a portion of the first shaft 7 of one transport roller 6 among the plurality of transport rollers 6 is illustrated, and illustration of the others is omitted. FIG. 2 illustrates a state where a side cover 8 on one side (−X side) of the image reading device 1 is removed.

Details of a structure of the medium transport device 11 will be further described later.

As illustrated in FIG. 1, the reading unit 4 is disposed along the transport path 3. The reading unit 4 optically reads an image of a medium that is transported on the transport path 3 to acquire image information. In the present embodiment, the transport path 3 includes a reversing portion 5.

A front surface of the image reading device 1 forms a medium placement portion 9 on which a medium is placed. The medium placement portion 9 is brought into an open state where the medium can be placed, by opening an upper end portion to the front side (+Y direction) with a lower end portion as a pivot point and horizontally positioning the upper end portion. In FIG. 1, the medium placement portion 9 is in a closed state.

The media placed on the medium placement portion 9 in the open state are picked up one by one by a pick roller (not shown), transported in the transport direction F in the transport path 3, read by the reading unit 4, transported through the reversing portion 5, and discharged to a discharge reception unit 10 located at an upper portion of the device body 2.

Medium Transport Device

Figure 4:
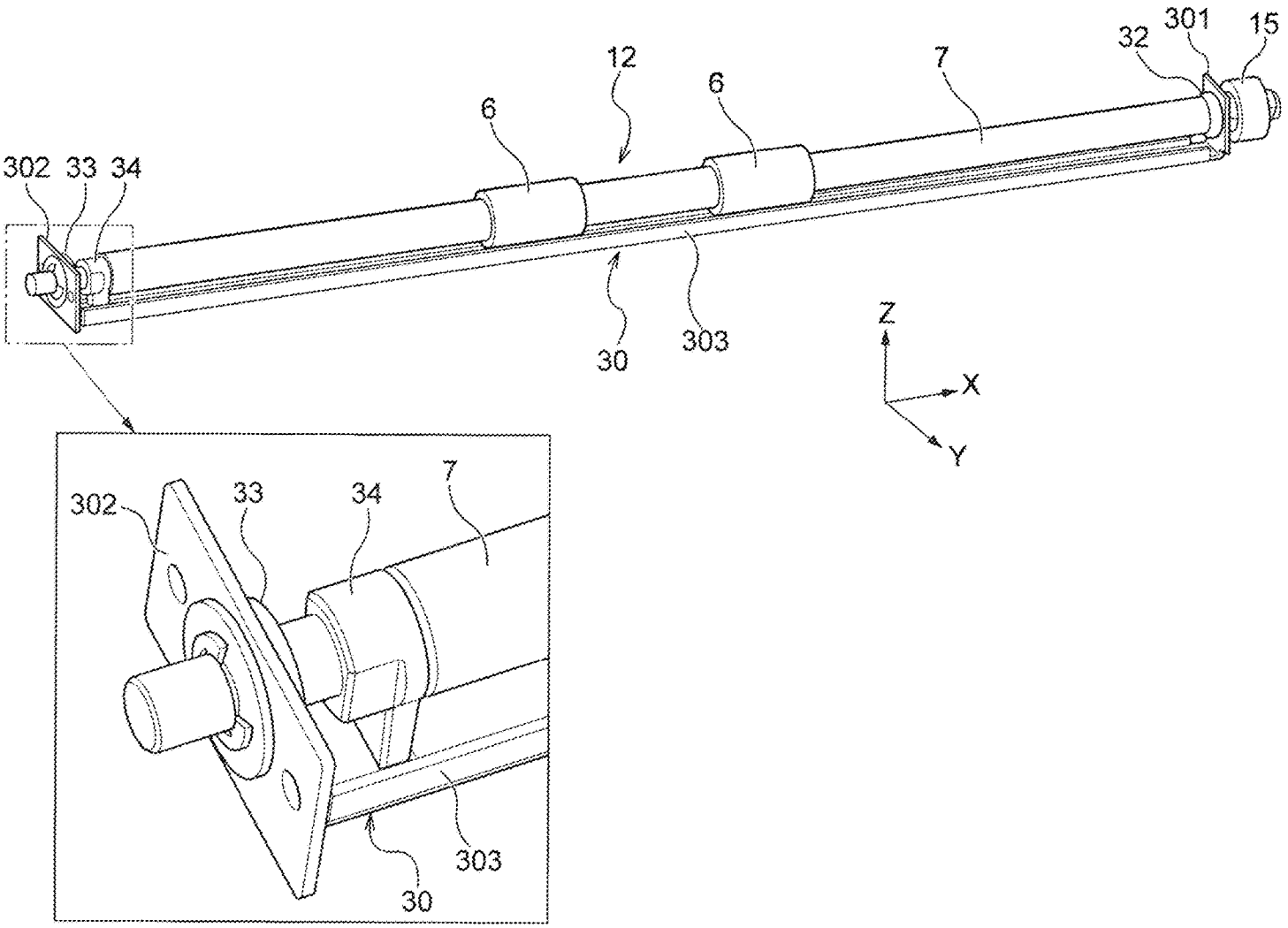
FIG. 4 is an overall perspective view of the transport roller unit according to Embodiment 1.
Figure 5:
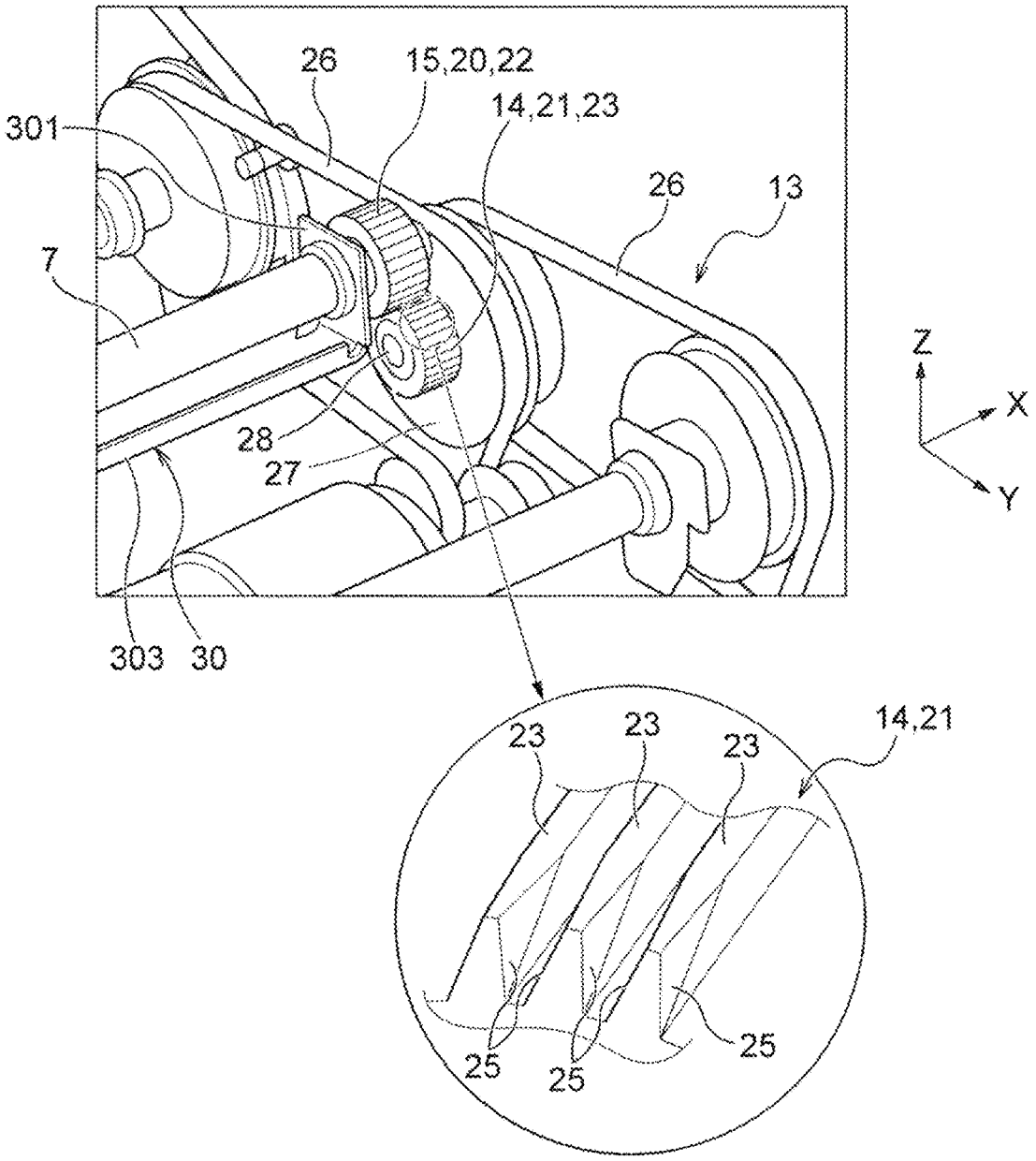
FIG. 5 is a main part perspective view illustrating a portion of a drive unit according to Embodiment 1.

As illustrated in FIGS. 4 and 5, the medium transport device 11 of the present embodiment includes a transport roller unit 12 including the transport rollers 6, and a drive unit 13 that drives the transport rollers 6. The drive unit 13 is driven by rotational power transmitted from a motor (not shown). The drive unit 13 includes a power transmitting portion 14 for transmitting rotational power to the transport roller unit 12. The transport roller unit 12 includes a power transmitted portion 15 for receiving transmission of the rotational power from the drive unit 13.

When the transport roller unit 12 moves in a direction (+X direction) approaching the drive unit 13, the power transmitting portion 14 and the power transmitted portion 15 are brought into a coupled state. That is, the rotational power is transmitted from the drive unit 13 to the transport roller unit 12 side. On the other hand, when the transport roller unit 12 moves in a direction (−X direction) away from the drive unit 13, the power transmitting portion 14 and the power transmitted portion 15 are brought into a uncoupled state. That is, the power transmitted portion 15 of the transport roller unit 12 is located away from the power transmitting portion 14 of the drive unit 13.

As illustrated in FIG. 2, in the present embodiment, the medium transport device 11 includes a plate-shaped first frame 16 located on one end side (+X side) of the first shaft 7 and a plate-shaped second frame 17 located on the other end side (−X side) of the first shaft 7. The first frame 16 is located inside a side cover (not shown) on the other side (+X side) of the image reading device 1. The drive unit 13 is held by the first frame 16. In other words, the drive unit 13 is attached to the first frame 16.

Figure 3:
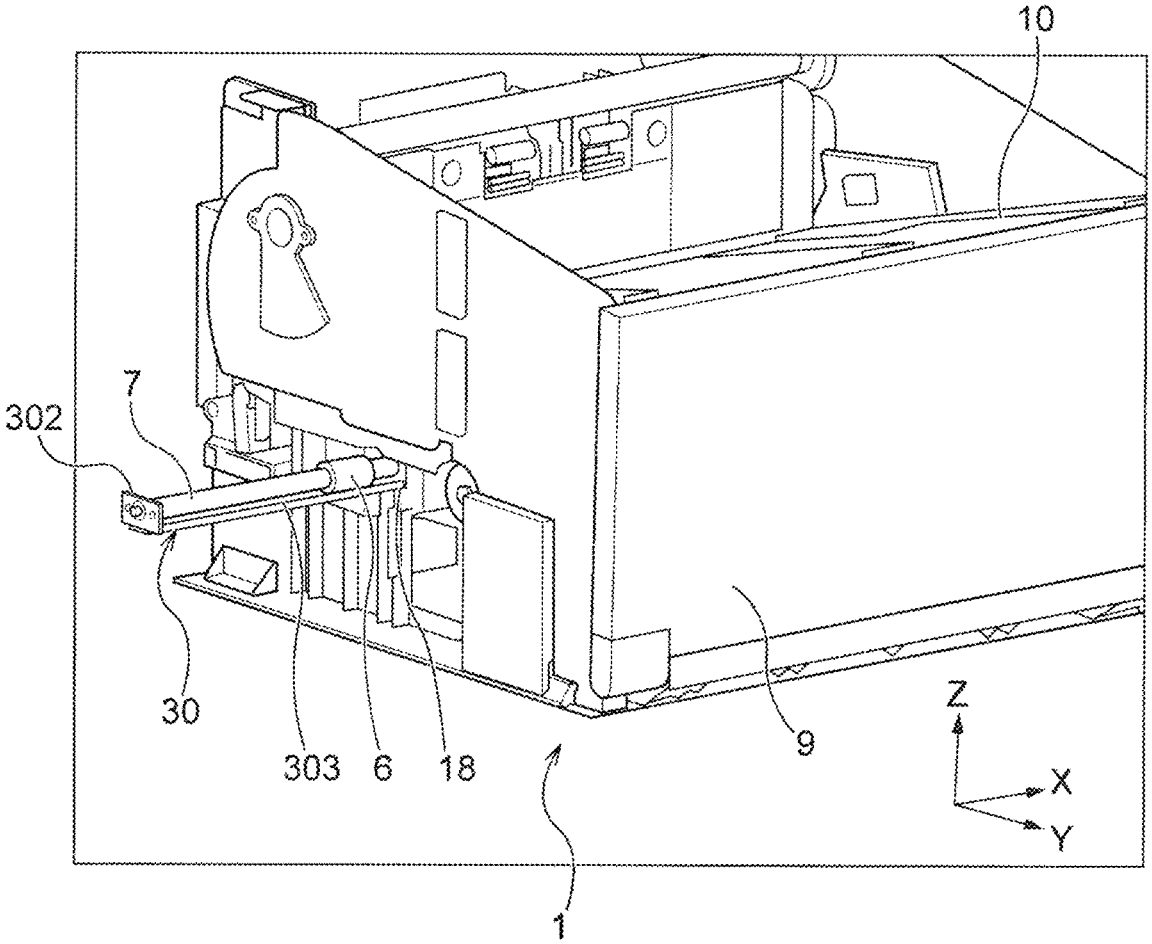
FIG. 3 is a perspective view illustrating a state where the transport roller unit is pulled out from the state illustrated in FIG. 2.

As illustrated in FIGS. 2 to 4, the transport roller unit 12 includes the first shaft 7 that supports the transport roller 6. The transport roller unit 12 is configured to move in the direction (X-axis direction) along the first shaft 7 through an insertion portion 18 (partially enlarged view of FIG. 2) of the second frame 17, to acquire the coupled state and the uncoupled state.

As illustrated in FIG. 5, in the present embodiment, the power transmitted portion 15 located at one end (+X side) of the first shaft 7 is a first gear 20, and the power transmitting portion 14 is the second gear 21 meshing with the first gear 20. Here, as shown in the partially enlarged view in FIG. 5, an inclined surface 25 that increases an interval between adjacent teeth 23 is formed at a portion where a plurality of first teeth 22 of the first gear 20 start to mesh with a plurality of second teeth 23 of the second gear 21 when the transport roller unit 12 moves in the approaching direction (+X direction) in the second gear 21.

The inclined surface 25 may be formed at the first gear 20 instead of the second gear 21, or may be formed at both the first gear 20 and the second gear 21.

As illustrated in FIG. 5, in the present embodiment, the drive unit 13 includes a toothed belt 26 and a pulley 27. The toothed belt 26 is wound around the pulley 27, and the pulley 27 rotates when rotational power is transmitted from a motor (not shown) and the toothed belt 26 rotates. The second gear 21 is configured to be attached to a second shaft 28 serving as a rotation center of the pulley 27 and rotate integrally with the pulley 27.

As illustrated in FIG. 4, in the present embodiment, the transport roller unit 12 includes a support portion 30 that rotatably supports the first shaft 7. The support portion 30 is made of a conductive material such as a sheet metal. The support portion 30 includes a first support portion 301 located on one end side (+X side) of the first shaft 7 and supporting the first shaft 7 via a bearing 32, a second support portion 302 located on the other end side (−X side) of the first shaft 7 and supporting the first shaft 7 via a bearing 33, and a base support portion 303 coupling the first support portion 301 to the second support portion 302. In FIG. 2, a reference sign 38 denotes a C-ring.

In the present embodiment, the first shaft 7 and the support portion 30 are coupled by a conductive member 34. Here, for the conductive member 34, a material having good conductivity such as brass is used.

Figure 6:
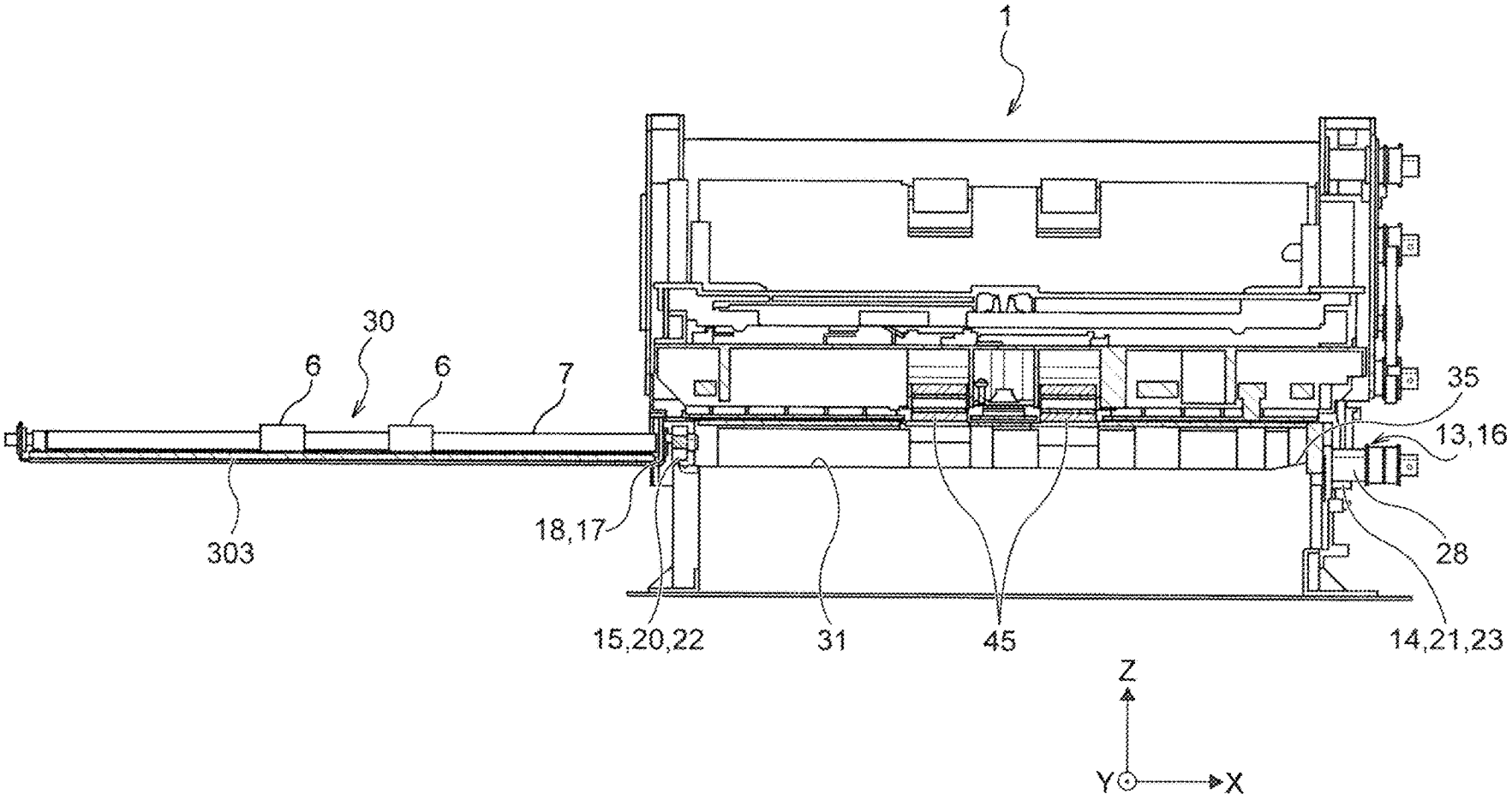
FIG. 6 is a front view of a state where insertion of the transport roller unit starts in the embodiment.
Figure 7:
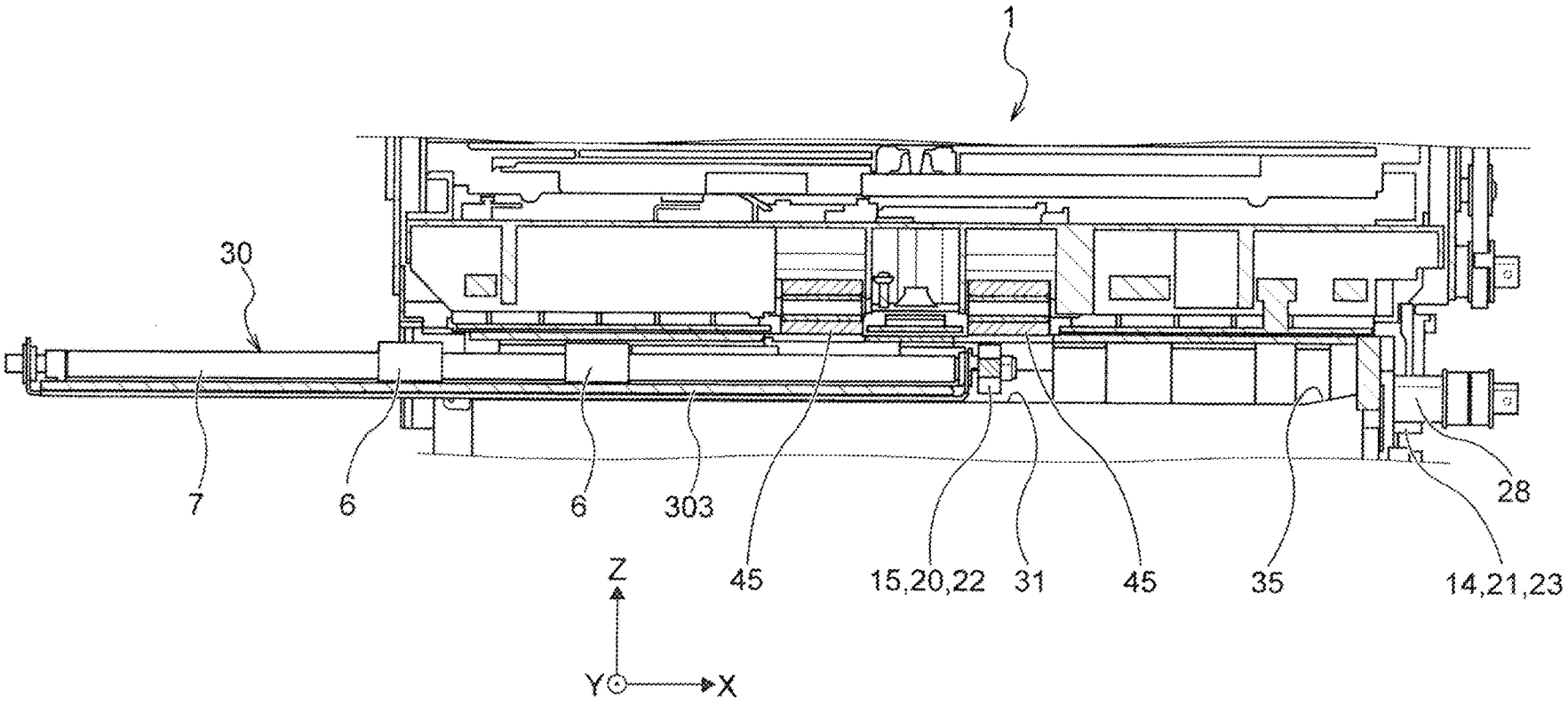
FIG. 7 is a front view of a state where the transport roller unit is further moved from the state illustrated in FIG. 6.
Figure 8:
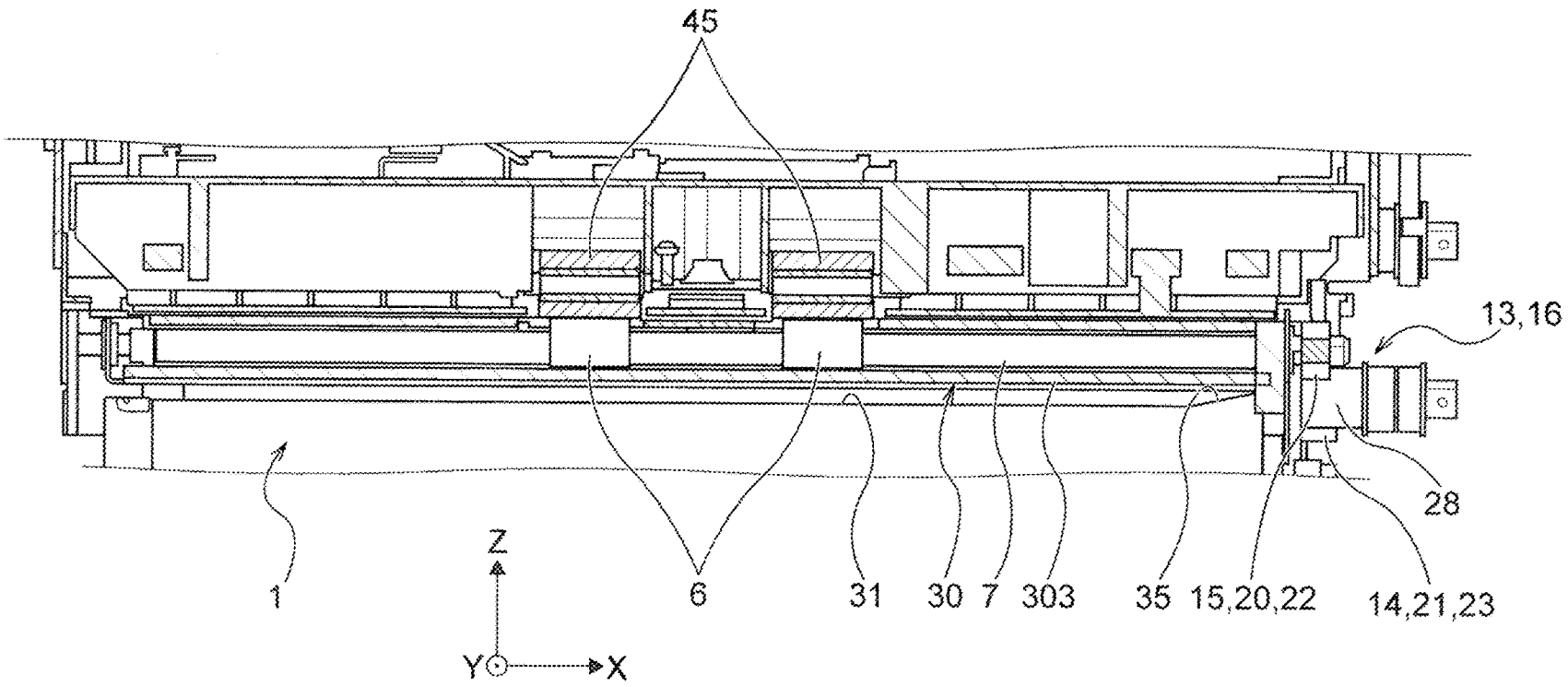
FIG. 8 is a front view of a state where movement of the transport roller unit has ended from the state in FIG. 7.

As illustrated in FIGS. 6 to 8, the medium transport device 11 includes a guide portion 31 that guides the support portion 30 when the transport roller unit 12 moves in the X-axis direction between the first frame 16 and the second frame 17. Here, the base support portion 303 of the support portion 30 is guided by the guide portion 31. Here, the guide portion 31 is formed in a rib shape. The base support portion 303 is moved and guided in the X-axis direction in a state where a lower surface of the base support portion 303 is in contact with an upper surface of the rib-shaped guide portion 31.

In the present embodiment, the rib-shaped guide portion 31 has the same height from the second frame 17 side to the front of the vicinity of the first frame 16, but a rising guide inclined surface 35 is formed in a region from a position of the front of the first frame 16 to the second gear 21 of the drive unit 13. The guide inclined surface 35 functions to easily reach a state where the first gear 20 and the second gear 21 mesh with each other, that is, the coupled state, by approaching obliquely from below to above when the first gear 20 is coupled to the second gear 21. Further, the guide inclined surface 35 also functions to bring into a state where the lower surface of the base support portion 303 is separated from the upper surface of the rib-shaped guide portion 31 in the coupled state.

In the coupled state of the first gear 20 and the second gear 21, the lower surface of the base support portion 303 is separated from the upper surface of the rib-shaped guide portion 31, as described above. As shown in the partially enlarged view of FIG. 2, in the transport roller unit 12, the second support portion 302 of the support portion 30 is fastened and fixed to the second frame 17 by screws 36 and 37 in the separated state. The transport roller unit 12 is configured to be fixed at a position where the transport roller 6 can apply a transport force to the medium in the fastened and fixed state.

The second frame 17 is provided with a positioning portion (not shown) for positioning the second frame 17 so that the second frame 17 can be fixed at the position. The transport roller unit 12 is fastened and fixed by the screws 36 and 37 in the positioned state. Although not shown in the partially enlarged view of FIG. 2, holes into which the screws 36 and 37 are inserted are formed in the second frame 17.

Figure 9:
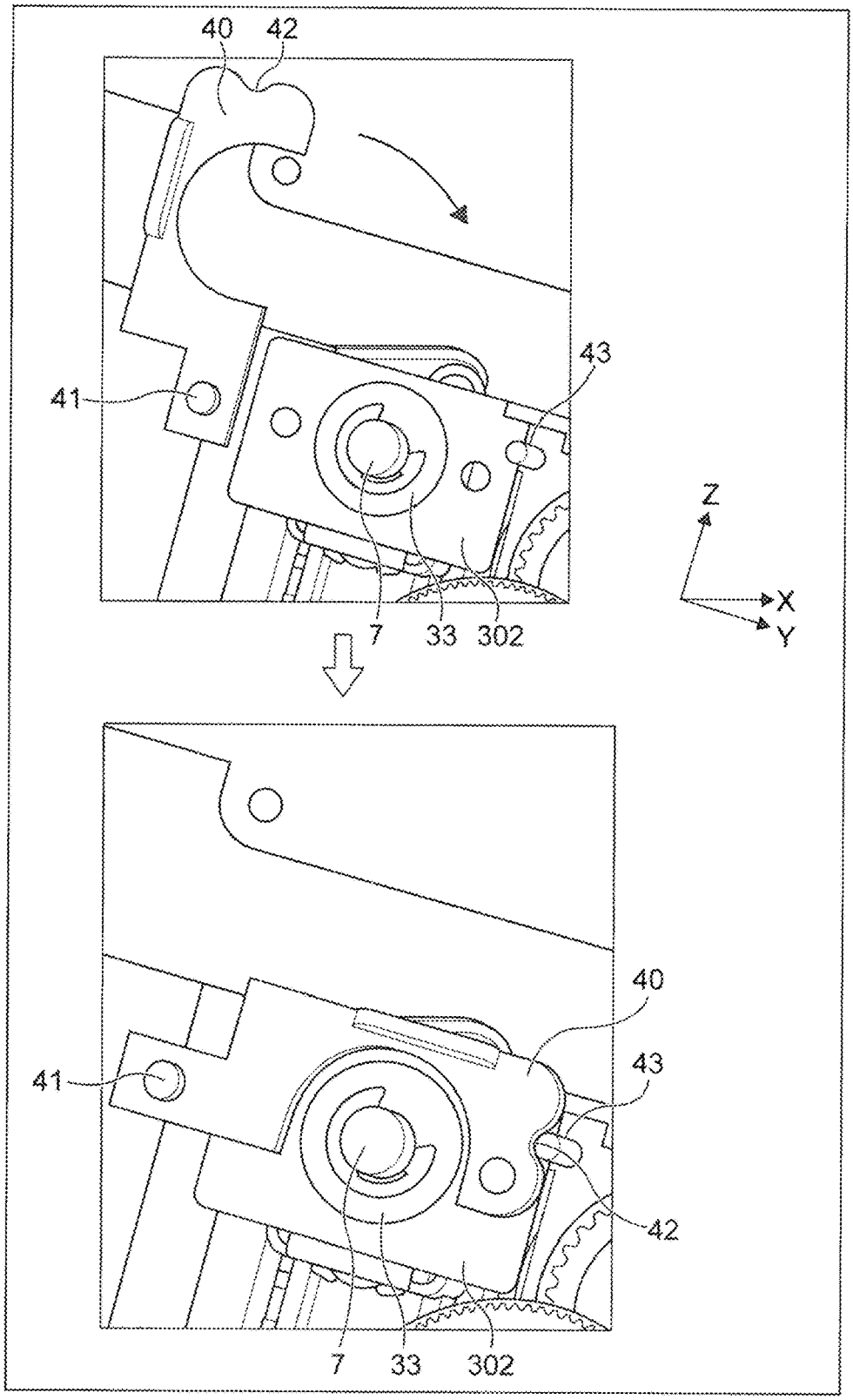
FIG. 9 is a perspective view illustrating a modification example of a fixing structure that fixes the second support portion to a second frame.

FIG. 9 illustrates a modification example of a fixing structure that fixes the second support portion 302 to the second frame 17. In this modification example, the screws 36 and 37 are not used, and a movable locking portion 40 is attached to the second frame 17 to rotate about a shaft 41 as a pivot point. The shaft 41 is attached to the second frame 17. In the movable locking portion 40, a locking concave portion 42 having a concave shape is formed at a side opposite to the shaft 41.

Further, a convex portion 43 is provided in the second frame 17, as illustrated in FIG. 9. The convex portion 43 is formed in a shape in which the locking concave portion 42 is locked. When the movable locking portion 40 is rotated in a direction of an arrow from a state shown in an upper drawing of FIG. 9, a state shown in a lower drawing of FIG. 9 is obtained, the locking concave portion 42 of the movable locking portion 40 is locked to the convex portion 43, and the second support portion 302 is fixed in this state. The second support portion 302 is positioned and fixed in a Y-axis direction and a Z-axis direction by a positioning portion (not shown).

Replacement of Transport Roller (1) Attachment of New Transport Roller

First, a case where a new transport roller 6 is attached to the device body 2 will be described with reference to FIGS. 6 to 8.

As illustrated in FIG. 6, in a state where the side cover 8 of the device body 2 is removed, the transport roller unit 12 is aligned with the insertion portion 18 of the second frame 17 and insertion in the +X direction starts.

Next, as illustrated in FIG. 7, the transport roller unit 12 is moved to be pushed in a state where the lower surface of the base support portion 303 of the support portion 30 is guided in the +X direction in a state where the lower surface is in contact with the rib-shaped guide portion 31.

With an additional movement, a distal end of the base support portion 303 in the moving direction reaches a position of a guide inclined surface 35 of the guide portion 31 and moves in the +X direction while obliquely rising along the guide inclined surface 35. At an end point of the movement, the first gear 20 of the transport roller unit 12 meshes with the second gear 21 of the drive unit 13 and the coupled state is obtained. In this state, the second support portion 302 is fastened and fixed to the second frame 17 by the screws 36 and 37. This state is illustrated in FIG. 8.

In FIG. 8, a reference sign 45 denotes a driven roller. As illustrated in FIG. 8, in the fastened and fixed state, the transport rollers 6 and 6 and the driven rollers 45 and 45 are in contact with each other. When the transport rollers 6 and 6 rotate in this state, the driven rollers 45 and 45 are driven to rotate and a transport force is applied to the medium.

(2) Removal of Transport Roller

As illustrated in FIG. 2, first, the side cover 8 is removed from the device body 2. Next, the screws 36 and 37 are removed from the second support portion 302. Accordingly, the transport roller unit 12 is in a state where the transport roller unit 12 can be pulled out in the −X direction.

Next, the transport roller unit 12 is pulled out in the −X direction, as illustrated in FIG. 3. The lower surface of the base support portion 303 of the support portion 30 moves obliquely downward on the guide inclined surface 35, is brought into a state where the lower surface is in contact with the upper surface of the guide portion 31, and moves in the −X direction, and finally, is entirely pulled out from the device body 2.

Effects of Embodiment 1

(1) In the medium transport device 11 of the present embodiment, when the transport roller unit 12 moves in a direction approaching the drive unit 13, the power transmitting portion 14 and the power transmitted portion 15 are brought into the coupled state, whereas when the transport roller unit 12 moves in a direction away from the drive unit 13, the power transmitting portion 14 and the power transmitted portion 15 enter a uncoupled state. Accordingly, when it is desired to remove the transport roller 6 for replacement or the like, the uncoupled state is obtained only by moving the transport roller unit 12 in a direction away from the drive unit 13, and thus, it is possible to easily remove the transport roller 6. When the transport roller unit 12 including another transport roller 6 is newly attached, the coupled state is obtained only by moving the transport roller unit 12 in a direction in which the transport roller unit 12 approaches the drive unit 13, and thus it is possible to easily perform the attachment.

In other words, it is possible to remove or attach the transport roller unit 12 only by moving the transport roller unit 12 without putting a hand on the drive unit 13, that is, in a state as it is, and thus it is possible to easily perform the replacement of the transport roller 6. Further, it is not necessary to adjust the tension of the drive unit 13 as in the related art, and it is possible to shorten a replacement time.

(2) Further, in the present embodiment, the transport roller unit 12 can take the coupled state and the uncoupled state by moving in the direction along the first shaft 7 through the insertion portion 18 of the second frame 17. As a result, it is possible to perform replacement of the transport roller 6 with a simple structure.

(3) Further, in the present embodiment, both the power transmitted portion 15 and the power transmitting portion 14 are configured of gears. Accordingly, a structure for realizing the coupled state and the uncoupled state is simple, and a task for switching between these states is easy.

(4) Further, in the present embodiment, the inclined surface 25 that increases the interval between the adjacent teeth 23, 23, . . . at a portion where the first gear 20 and the second gear 21 start to mesh with each other by moving in an approaching direction is formed in at least one of the first gear 20 and the second gear 21. With the inclined surface 25, it is easy to move the transport roller unit 12 in a direction approaching the drive unit 13 and obtain the coupled state.

(5) In the medium transport devices 11, the drive unit 13 has a structure in which the toothed belt 26 and the pulley 27 are included, and in the related art, when the transport roller 6 is replaced, it is necessary to remove the toothed belt 26 from the pulley 27.

However, in the present embodiment, the second gear 21 is attached to the second shaft 28 serving as the rotation center of the pulley 27 and rotates integrally with the pulley 27. Therefore, change from the coupled state to the uncoupled state can occur by moving the transport roller unit 12 in a direction away from the drive unit 13. This makes it possible to easily remove the transport roller unit 12 from the drive unit 13 and thus easily perform replacement of the transport roller 6.

(6) Further, in the present embodiment, when the transport roller unit 12 is moved from the second frame 17 side toward the first frame 16, the support portion 30 is guided along the guide portion 31. Thus, it is possible to easily move the transport roller unit 12.

(7) The first shaft 7 is supported by the second support portion 302 via the bearing 33. When the bearing 33 continues to be used, characteristics of a lubricating oil inside the bearing 33 deteriorates, and the conductivity of the bearing 33 is degraded. Therefore, in a structure in which the first shaft 7 is grounded via the bearing 33, there is concern that the grounding characteristic also deteriorates.

However, in the present embodiment, the first shaft 7 and the conductive support portion 30 are coupled by the conductive member 34 such as brass. Thus, even when a grounding characteristic of the bearing 33 is degraded, the first shaft 7 can be continuously grounded by the conductive member 34.

Other Embodiments

The medium transport device 11 and the image reading device 1 including the medium transport device 11 according to the present disclosure are based on the configuration of the embodiments described above but, as a matter of course, changes, omission, and the like may be made to a partial configuration without departing from the gist of the present disclosure.

Figure 10:
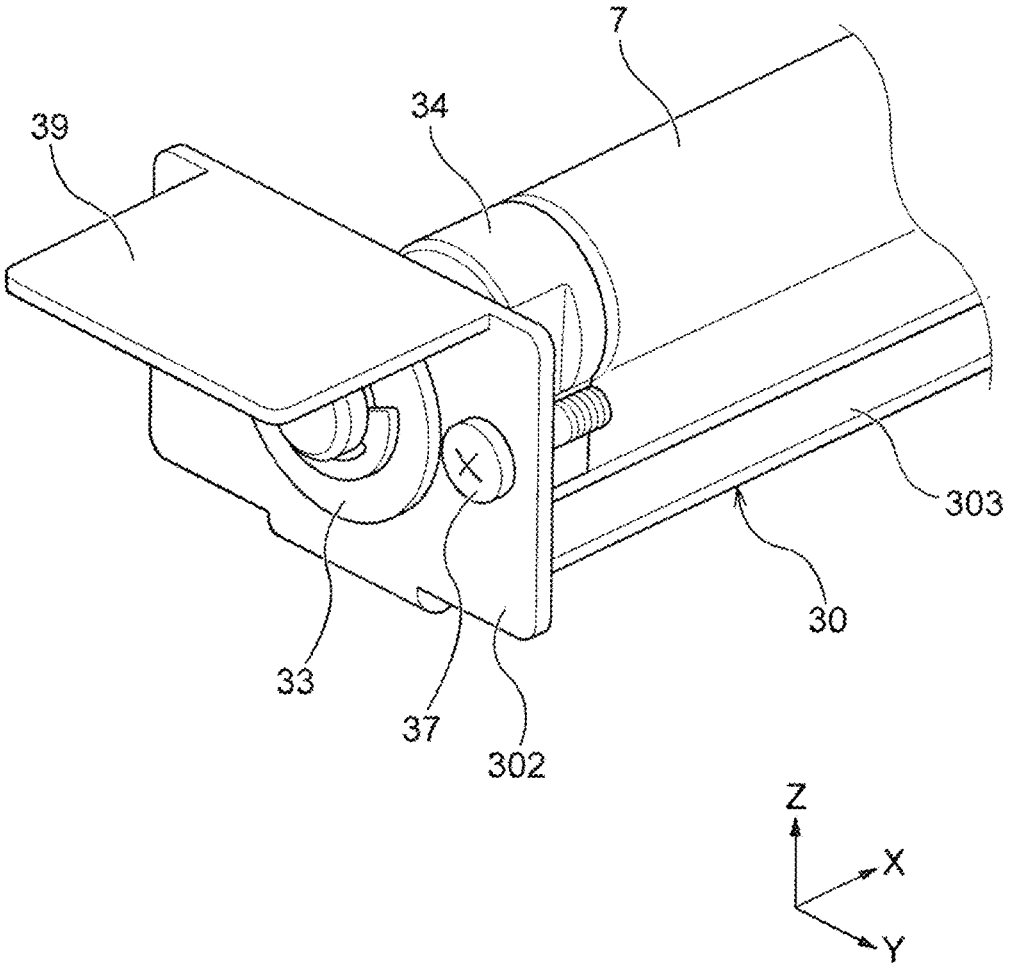
FIG. 10 is a perspective view of a structure in which a handle is provided on the second support portion.

As illustrated in FIG. 10, it is preferable to provide a handle 39 on the second support portion 302 of the transport roller unit 12. When the handle 39 is provided, the user can move the transport roller unit 12 by holding the handle 39, and thus, operability is improved.

Further, although the transport roller unit 12 has been described as a structure including the support portion 30 in the embodiment, the support portion 30 may be omitted and the first shaft 7 may be directly moved in the X-axis direction.

What is claimed is:

1. A medium transport device comprising:
a transport roller unit including a plurality of transport rollers configured to transport a medium;
a drive unit configured to drive the plurality of transport rollers, wherein
the drive unit includes a power transmitting portion,
the transport roller unit further includes a power transmitted portion,
the power transmitting portion and the power transmitted portion are brought into a coupled state by the transport roller unit moving in a direction approaching the drive unit, and
the power transmitting portion and the power transmitted portion are brought into an uncoupled state by the transport roller unit moving in a direction away from the drive unit;
a first frame; and
a second frame facing the first frame, wherein
the transport roller unit further includes a first shaft configured to support a transport roller of the plurality of transport rollers,
the first frame is located on a first end side of the first shaft,
the second frame is located on a second end side of the first shaft,
the drive unit is held by the first frame,
the transport roller unit is brought into the coupled state or the uncoupled state by moving in a direction along the first shaft through an insertion portion of the second frame,
the power transmitted portion located at one end of the first shaft is a first gear,
the power transmitting portion is a second gear that meshes with the first gear, and
an inclined surface that increases an interval between adjacent teeth of the second gear is formed at a portion where a plurality of first teeth of the first gear starts to mesh with a plurality of second teeth of the second gear by moving in the approaching direction in at least one of the first gear and the second gear.

2. The medium transport device according to claim 1, wherein
the drive unit includes
a toothed belt; and
a pulley around which the toothed belt is wound to rotate, and
the second gear is attached to a second shaft serving as a rotation center of the pulley, and rotates integrally with the pulley.

3. The medium transport device according to claim 1, wherein
the transport roller unit further includes a support portion configured to rotatably support the first shaft, and
a guide portion configured to guide the support portion at a time of movement is included between the first frame and the second frame.

4. The medium transport device according to claim 3, wherein
the support portion is electrically conductive, and includes
a first support portion located on the first end side of the first shaft and supporting the first shaft via a first bearing;
a second support portion located on the second end side of the first shaft and supporting the first shaft via a second bearing; and
a base support portion configured to couple the first support portion to the second support portion, and
the first shaft and the support portion are coupled by a conductive member.

5. An image reading device comprising:
the medium transport device according to claim 1; and
a reading unit configured to read an image of the medium.

6. A medium transport device comprising:
a transport roller unit including a plurality of transport rollers configured to transport a medium;
a drive unit configured to drive the plurality of transport rollers, wherein
the drive unit includes
a power transmitting portion,
a toothed belt, and
a pulley around which the toothed belt is wound to rotate,
the transport roller unit further includes a power transmitted portion,
the power transmitting portion and the power transmitted portion are brought into a coupled state by the transport roller unit moving in a direction approaching the drive unit, and the power transmitting portion and the power transmitted portion are brought into an uncoupled state by the transport roller unit moving in a direction away from the drive unit;

a first frame; and a second frame facing the first frame, wherein the transport roller unit further includes a first shaft configured to support a transport roller of the plurality of transport rollers, the first frame is located on a first end side of the first shaft, the second frame is located on a second end side of the first shaft, the drive unit is held by the first frame, the transport roller unit is brought into the coupled state or the uncoupled state by moving in a direction along the first shaft through an insertion portion of the second frame, the power transmitted portion located at one end of the first shaft is a first gear, the power transmitting portion is a second gear that meshes with the first gear, and the second gear is attached to a second shaft serving as a rotation center of the pulley, and rotates integrally with the pulley.

7. The medium transport device according to claim 6, wherein the transport roller unit further includes a support portion configured to rotatably support the first shaft, and a guide portion configured to guide the support portion at a time of movement is included between the first frame and the second frame.

8. The medium transport device according to claim 7, wherein the support portion is electrically conductive, and includes a first support portion located on the first end side of the first shaft and supporting the first shaft via a first bearing;

a second support portion located on the second end side of the first shaft and supporting the first shaft via a second bearing; and a base support portion configured to couple the first support portion to the second support portion, and the first shaft and the support portion are coupled by a conductive member.

9. An image reading device comprising:

the medium transport device according to claim 6; and a reading unit configured to read an image of the medium.

10. A medium transport device comprising:

a transport roller unit including a plurality of transport rollers configured to transport a medium;

a drive unit configured to drive the plurality of transport rollers, wherein the drive unit includes a power transmitting portion, the transport roller unit further includes a power transmitted portion, the power transmitting portion and the power transmitted portion are brought into a coupled state by the transport roller unit moving in a direction approaching the drive unit, and the power transmitting portion and the power transmitted portion are brought into an uncoupled state by the transport roller unit moving in a direction away from the drive unit;

a first frame; and a second frame facing the first frame, wherein the transport roller unit further includes a first shaft configured to support a transport roller of the plurality of transport rollers, a support portion configured to rotatably support the first shaft, and a guide portion configured to guide the support portion at a time of movement is included between the first frame and the second frame, the first frame is located on a first end side of the first shaft, the second frame is located on a second end side of the first shaft, the support portion is electrically conductive, and includes a first support portion located on the first end side of the first shaft and supporting the first shaft via a first bearing;

a second support portion located on the second end side of the first shaft and supporting the first shaft via a second bearing; and a base support portion configured to couple the first support portion to the second support portion, the first shaft and the support portion are coupled by a conductive member, the drive unit is held by the first frame, and the transport roller unit is brought into the coupled state or the uncoupled state by moving in a direction along the first shaft through an insertion portion of the second frame.

11. An image reading device comprising:

the medium transport device according to claim 10; and a reading unit configured to read an image of the medium.

* * * * *